US008899797B2

(12) United States Patent
Schaak

(10) Patent No.: US 8,899,797 B2
(45) Date of Patent: Dec. 2, 2014

(54) LAMP WITH DESK ORGANIZER AND ELECTRONICS STAND

(75) Inventor: Lee Schaak, Dix Hills, NY (US)

(73) Assignee: Adesso Inc., New York, NY (US)

( * ) Notice: Subject to any disclaimer, the term of this patent is extended or adjusted under 35 U.S.C. 154(b) by 183 days.

(21) Appl. No.: 13/567,444

(22) Filed: Aug. 6, 2012

(65) Prior Publication Data

US 2014/0036518 A1 Feb. 6, 2014

(51) Int. Cl.
*F21S 8/08* (2006.01)
*F21V 33/00* (2006.01)
*F21V 21/32* (2006.01)

(52) U.S. Cl.
CPC ..... *F21V 33/0048* (2013.01); *F21V 21/32* (2013.01)
USPC ..... 362/410

(58) Field of Classification Search
CPC ..... F21S 6/002; F21S 6/003; F21S 6/005; F21S 13/12; F21V 21/00; F21V 21/06; F21V 33/0048
USPC ..... 362/410
See application file for complete search history.

(56) References Cited

U.S. PATENT DOCUMENTS 5,816,459 A * 10/1998 Armistead ..... 224/246
2006/0209530 A1* 9/2006 Schaak ..... 362/86

OTHER PUBLICATIONS

"Butler Rotondo," WEDO. N.p., n.d. Web. Mar. 3, 2014. <http://www.wedo.de/office_products/desktop_accessoires/organisers1>.

* cited by examiner

*Primary Examiner* — Jason Moon Han
(74) *Attorney, Agent, or Firm* — Leason Ellis LLP

(57) ABSTRACT

A desk lamp includes an organizer for desktop items and stand for electronic devices. The lamp has a support with a surface for receiving an organizer. The organizer has at least one or more cavities. The walls of one or more adjacent cavities define one or more slots which can be shaped to receive an electronic device. The desk lamp further includes a neck for coupling a terminal housing to the support. A bulb socket is attached to the terminal housing to receive a light bulb. A power cord electrically couples the bulb socket to a battery compartment or to an electrical plug. In addition the lamp can include a power outlet that is electrically coupled to the power cord as well as a transformer and a charging circuit for electrically providing power to other devices.

18 Claims, 6 Drawing Sheets

LAMP WITH DESK ORGANIZER AND ELECTRONICS STAND

TECHNICAL FIELD OF THE INVENTION

Figure 1:
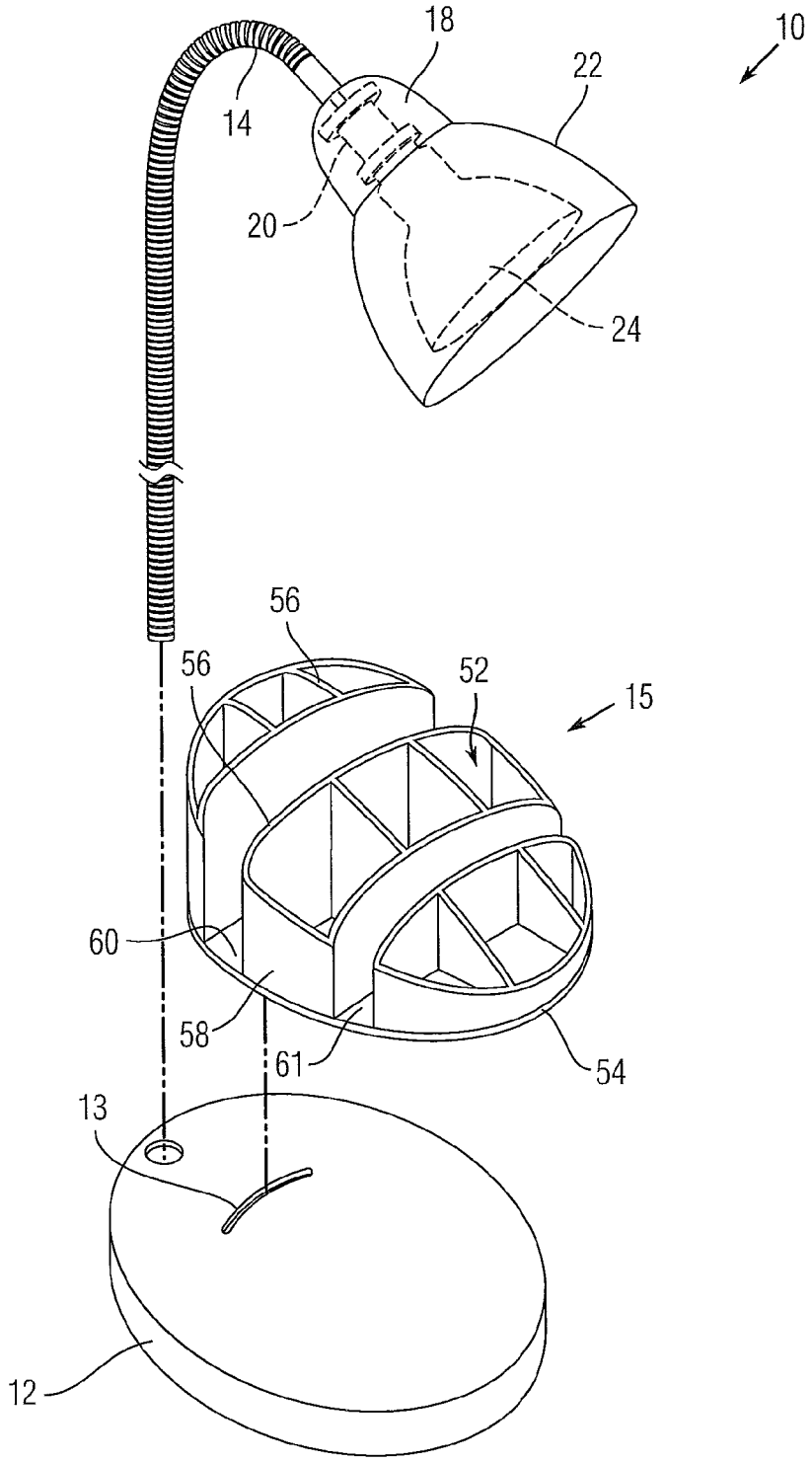

The present invention relates to a lighting apparatus, and more particularly, to an improved desk lamp having an organizer for holding desktop items and electronic devices such as a tablet computer and smart phone.

BACKGROUND OF THE INVENTION

Conventional lighting apparatuses are useful as sources of electrically-generated light, and are also popular for decorative purposes. Standard organizers for desktop items (i.e. paperclips, pens) are usually placed on a desk which often also has as a desk lamp placed thereon. Furthermore, stands for electronic devices (i.e. tablet computers and smart phones) are also often placed on a desk for ease of use. This can make the desk crowded. There is a continuing need for integrating desktop devices thereby minimizing desk space and avoiding clutter from associated wired connections.

Thus, it would be desirable to provide a desk lamp having an integrated organizer and electronic device stand in order to eliminate the need for having separate organizer, stand and lamp apparatus, in order to save desk space and to reduce unnecessary clutter from conventional desktop devices. It would further be desirable to coordinate and combine electrical fittings suitable for both the lamp and various electronic devices. The present invention satisfies these and other needs.

SUMMARY OF THE INVENTION

The present invention is for desk lamp including an organizer for desktop items and stand for electronic devices. The lamp has a support or base, the support having at least a surface for receiving an organizer. The organizer has at least one or more cavities defined by a bottom surface and one or more peripheral walls and one or more interior dividing walls. The interior dividing walls of one or more adjacent cavities define one or more slots. The lamp further includes a neck having a first portion coupled to the support mount surface and a second portion remote from the first portion. A terminal housing is fixedly disposed relative to the neck second portion, a bulb socket including a seat portion is attached to the terminal housing, and a shell portion of the terminal housing is shaped to receive the base of a light bulb. The lamp in addition includes a power cord including a pair of insulated conductive cord members, electrically coupled at one end to the bulb socket and at another end to a battery compartment or to an electrical plug.

The lamp support can further include one or more power outlets disposed on the support. The one or more power outlets having a first end that is directed internally of the support and is electrically coupled to the power cord, and having a second end that is accessible at an external surface of the support.

The lamp support can further include a transformer electrically coupled to the power cord and a charging circuit electrically connected to the transformer. In addition, a socket can be disposed on the support. The socket having a first end that is directed internally of the support and is electrically coupled to the charging circuit, and having a second end that is accessible at an external surface of the support for electrical coupling to an electronic device compatible cable.

Alternatively the lamp support can also include a plug disposed on the support and the organizer, the plug having a first end that is directed internally of the support and is electrically coupled to the charging circuit, and having a second end that is accessible at an external surface of the organizer for electrical coupling to an electronic device. The plug can be retractably extended from the lamp support temporarily for attaching one or more electronic devices.

These and other aspects, features, steps and advantages can be further appreciated from the accompanying drawing Figures and description of certain illustrative embodiments.

BRIEF DESCRIPTION OF THE DRAWING FIGURES

Figure 4:
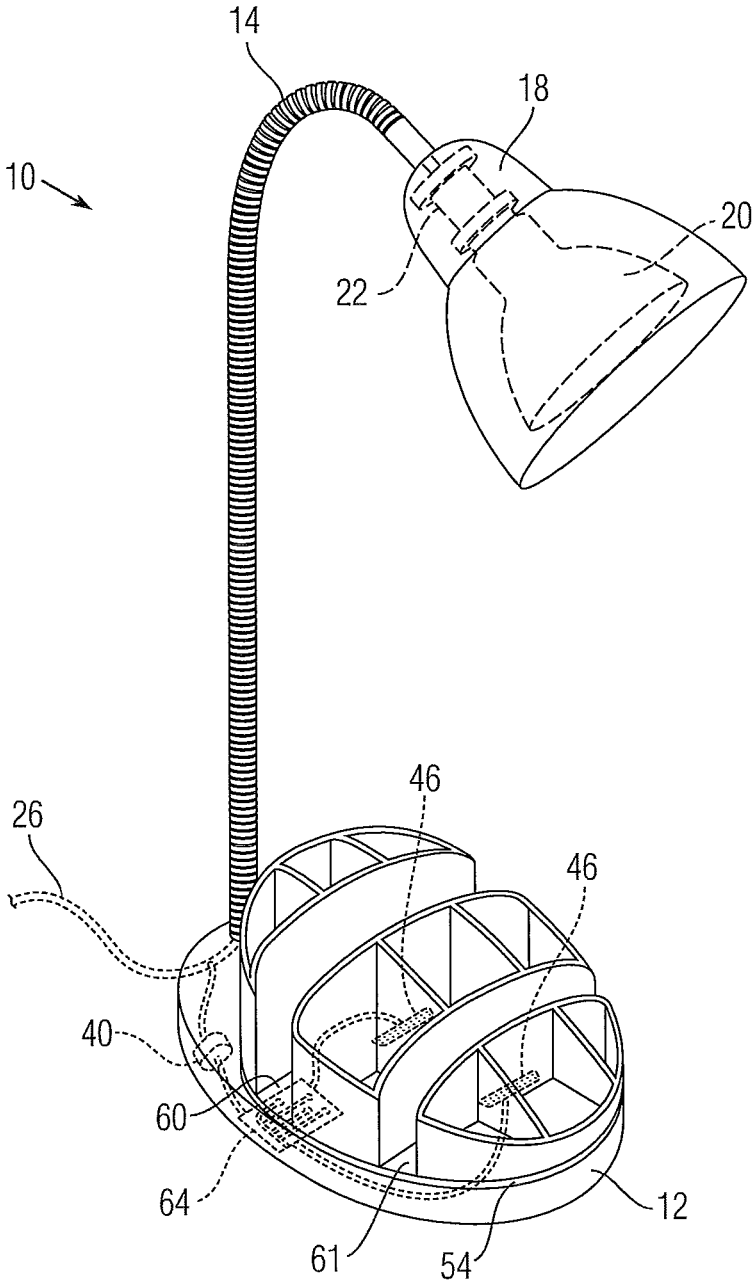
Figure 5:
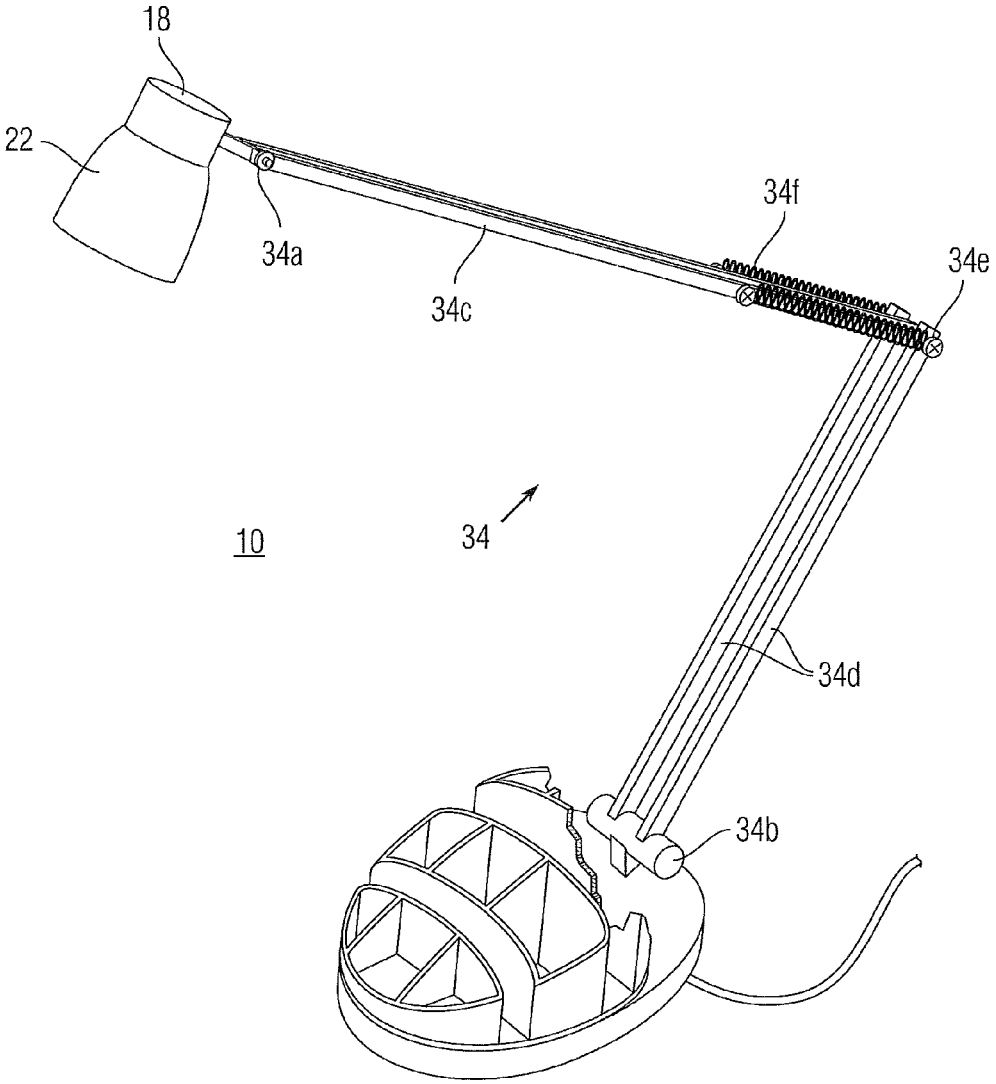
Figure 6:
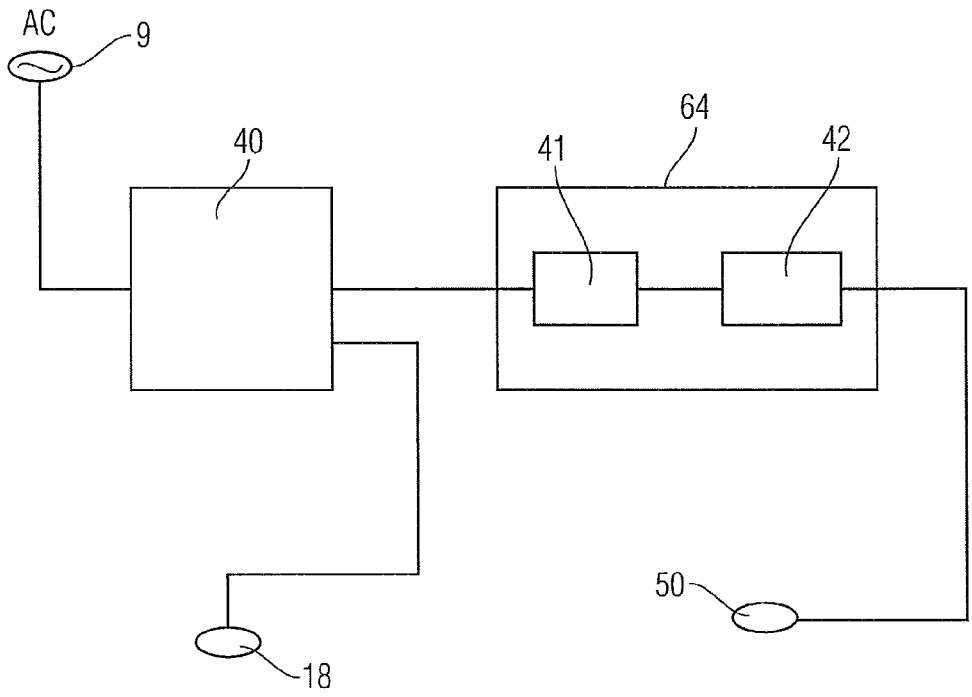

FIGS. 1-5 provide perspective views of lamps that are in accordance with principles of the disclosed embodiments; and FIG. 6 is a schematic drawing of the charging circuit of the lamp, in accordance with principles of the disclosed embodiments.

DETAILED DESCRIPTION OF CERTAIN EMBODIMENTS OF THE INVENTION

The following detailed description illustrates the invention by way of example, and not by way of limitation. This description will clearly enable one skilled in the art to make and use the invention, and describes several embodiments, adaptations, variations, alternatives and uses of the invention, including what we presently believe is the best mode of carrying out the invention. It should be understood that any feature described in one embodiment or arrangement can be equally applied to any other embodiment or arrangement without departing from the spirit of the present invention.

Figure 2:
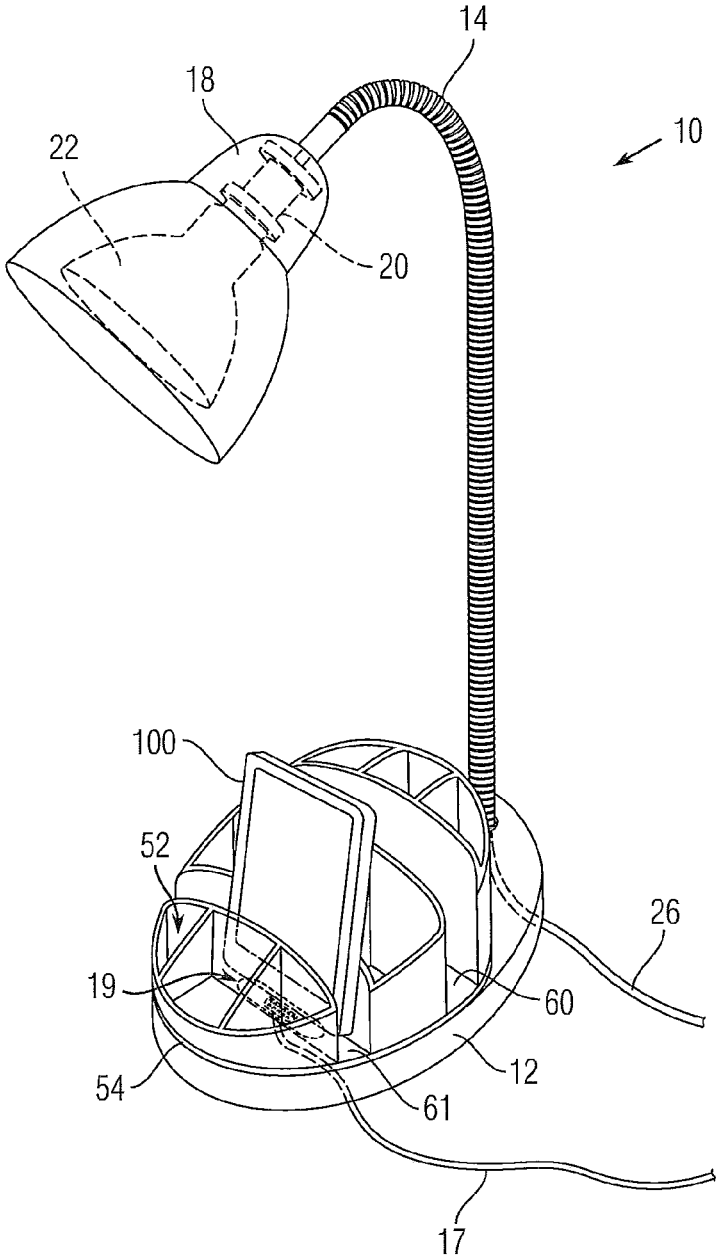

By way of overview and introduction, described is a lighting apparatus having an integrated organizer and stand for electronic devices. Referring to FIGS. 1 and 2, a perspective view of a lighting apparatus 10 constructed in accordance with the invention is shown. The lighting apparatus 10 includes a support 12 to which is connected a flexible neck 14. The flexible neck 14 extends from support 12. At a distal end of the neck 14 remote from the support 12 is a terminal housing 18, to which is mounted a bulb socket 20 and a lamp shade 22

As an alternative to the flexible neck 14 illustrated in FIGS. 1 and 2, the lighting apparatus 10 may alternatively be fitted with an articulable neck 34 as illustrated in FIG. 5. As illustrated in FIG. 5, the articulable neck 34 comprises a jointed connector 34*a*, a jointed connector 34*b* and neck assembly 34*c*, 34*d*, 34*e* and 34*f*. Jointed connector 34*a* interconnects terminal housing 18 to upper neck member 34*c*, in a manner allowing for rotational movement of terminal 18 in at least one plane relative to upper member 34*c*. Jointed connector 34*b* interconnects support 12 to lower neck members 34*d* in a manner allowing for rotational movement of lower neck members 34*d* in at least one plane relative to support 12. Preferably, connector 34*b* is additionally rotatable in support 12 to allow for rotational movement of lower neck members 34*d* in an additional plane that is orthogonal to the one plane relative to support 12.

Jointed connector 34*e* interconnects upper neck member 34*c* to lower neck members 34*d* in a manner allowing for rotational movement of upper neck members 34*c* in at least one plane relative to lower neck members 34*d*. A selected position of upper neck member 34*c* in relation to lower neck members 34*d* may be maintained by a spring 34*f*, which resists additional movement due to the application of gravitational force on upper neck member 34*c* and terminal housing. Alternatively, jointed connector 34*e* may be configured so that frictional forces within the jointed connector 34*e* resist such movement. Connectors 34*a* and 34*b* may be similarly connected. In this manner, articulable neck 34 enables the lamp assembly 18, 22 to be movably positioned during use, and to be retractably folded after use for compact storage.

It should be understood that the articulable neck 34 may alternatively be configured with a single neck member that interconnects jointed connectors 34*a* and 34*b*. The single neck member may either fixed, or assembled in telescoping sections to permit the neck 34 to be collapsed from an extended position for compact storage.

The lamp shade 22 can have a variety of conventional configurations, and adds an eye-pleasing effect to the lighting assembly. For example, the lamp shade 22 may be configured as a globe, a shade, or any other suitable surrounding for a light source 24, as is known in the art. Furthermore, lamp shade 22 and terminal housing 18 is not required to be two separate pieces and may be combined to form a single unit.

Support 12 may be readily fabricated from one or more sheet metal stampings, or alternatively, from one or more plastic components fabricated for example by injection molding. For example, support 12 may be fabricated as a transparent plastic housing. Alternatively, support 12 may be fabricated as a translucent plastic housing.

As illustrated in FIGS. 1 and 2, an organizer 15 is coupled to the support 12. Organizers of various configurations are well known in the art, for example, the basic WEDO® Rotondo Organizer design. Organizer 15 conveniently features cavities 52, for placement and retention of small, miscellaneous desktop items (for example, paper clips and the like). Cavities 52 are integrally formed with a bottom 54, which can be common to all the cavities 52. The cavities 52 also have peripheral walls 58 which form the exterior side of the organizer. While FIGS. 1 and 2 depict organizer 15 with peripheral walls 58 that define a generally circular organizer 15, organizer 15 can be formed in a variety of shapes and sizes. Cavities 52 also have interior dividing walls 56, which are parallel or perpendicular to the direction the lighting apparatus is facing. Furthermore, the height of the interior dividing walls 56 and peripheral walls 58 can vary such that some cavities 52 are taller than others.

The interior dividing walls 56 of adjacent cavities 52 define slots 60 and 61 that run perpendicular to the direction that the lighting apparatus 10 is facing. Slots 60 and 61 are constructed in accordance with the invention so as to have a width sufficient to accommodate one or more electronic devices 100 and can be of different dimensions including different widths and/or heights to accommodate various devices. For example, the slot 60 preferably has a width to accept a tablet computer such as an iPad® by Apple Inc. and slot 61 preferably has a width to accept a smart phone such as an iPhone® by Apple Inc. The cavities 52 can define any number of slots in any width and orientation relative to the direction of the lighting apparatus 10. The curvature of the slots 60 and 61 that are formed by the interior dividing walls 56 and bottom 54 can be shaped such that they receive the electronic device 100 in a particular location and orientation or in a manner that does not cause stress or damage to the electronic device. The slots 60, 61 are preferably formed to have open ends to allow the slot to receive from a lateral direction and contain at least in part, an electronic device 100. The electronic device is kept by the organizer, yet can extend beyond the organizer's perimeter.

Furthermore, the walls of slots 60 and 61 can be covered with one or more materials that protect the electronic device from damage. For example, the protective material can be a soft textile that will not scratch the surface of the electronic device, or a rubberized coating that protects the electronic device from a jarring impact if placed in slot 60 or 61 with excessive force.

Organizer 15 can be fabricated, for example, by injection molding using a hard plastic material, such as an ABS material, polycarbonate, an acrylic material, or similar materials. Obviously, other modern manufacturing techniques can be used to form the organizer described herein with parts and assembling components together to form the organizer. It will also be understood that the organizer 15 can be formed of two or more parts that are complementary to one another and in one embodiment, can be joined to one another (e.g., a snap-fit) to form an assembled organizer structure.

Organizer 15 can be fixedly or removably attached to support 12. For example, organizer can be joined to support by heat welding, glue or other adhesive, rivets, screws, fasteners, slot and tab joints or other suitable temporary or permanent joining means. Optionally support includes locating feature 13, such as a depression formed on the surface of the support 12 or alternatively a raised lip. A complementary locating feature can be formed on the bottom of the organizer 15 such that the organizer 15 can be aligned and matingly coupled to the support 12.

As illustrated in FIG. 2, the bottom 54 of the organizer 15, and support 12 can shaped to define one or more orifices 19 located at slots 60 and/or 61. A cable 17, such as a power cable or audio cable, is feedable through the one or more orifices 19 and operable to connect, for example, to the headset jack or other audio output terminal or power terminal of electronic device 100 as indicated.

Figure 3:
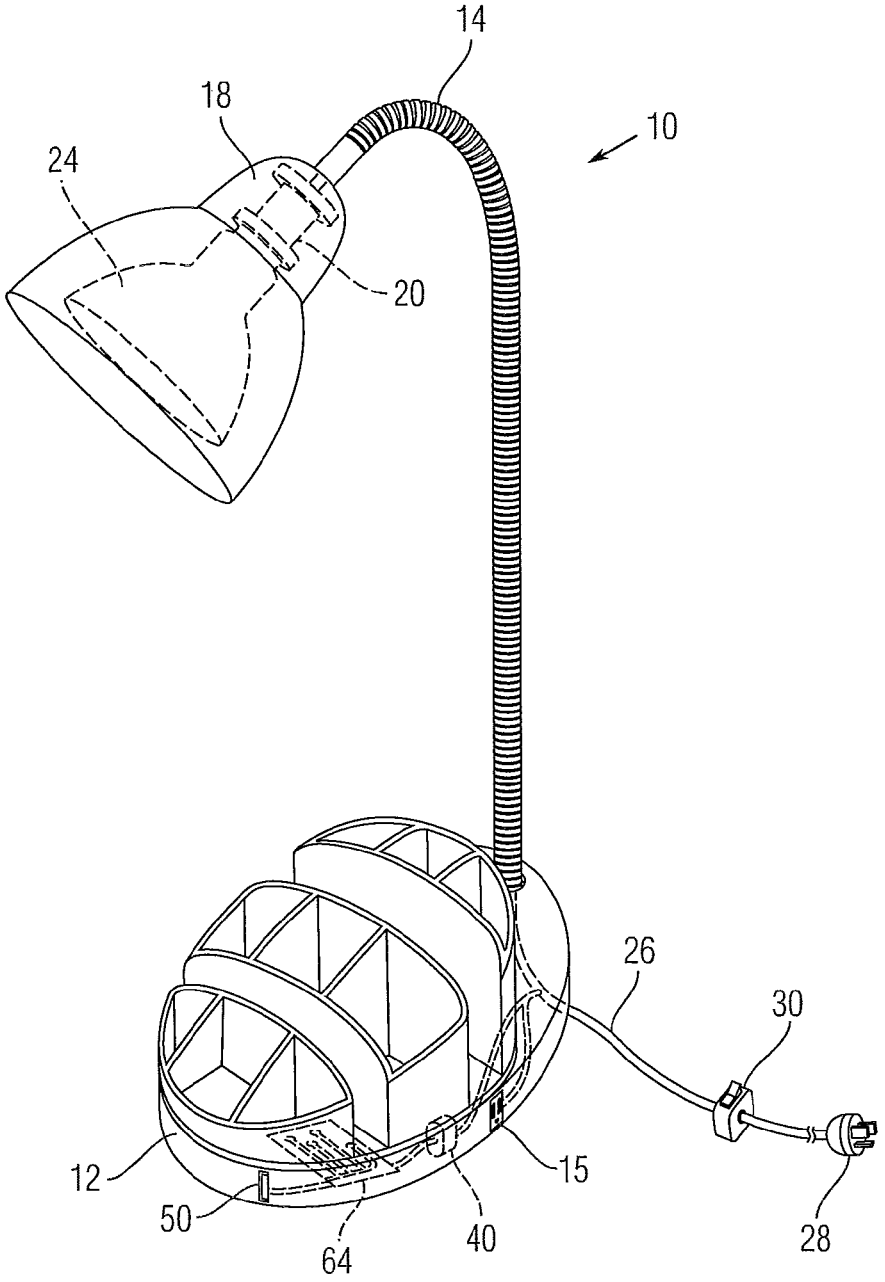

Referring to FIG. 3, power cord 26 may for example be composed of lamp cord, include an electrical power plug 28 at one end, and be conductively coupled at another end to the bulb socket 20 either directly or through a switch 30. The switch 30 can for example be located along the lamp cord, be integral with the bulb socket 20, be mounted to the terminal housing, or be mounted to another portion of the lighting apparatus 10 including support 12. The mechanism for switch 30 can, for example, be implemented as a conventional rotary switch, a push/pull switch, a microswitch or a capacitive switch. The light source 24 (e.g., incandescent bulb, halogen lamp, fluorescent bulb, or one or more LEDs) is mounted in the bulb socket 20 and positioned in a plurality of positions relative to the support 12 by arrangement of the flexible neck 14.

Support 12 has a mass which is sufficient to overcome any turning moments created when the light source 24 is cantilevered out beyond an edge of the support 12, thus preventing the lighting assembly 10 from tipping.

The flexible neck 14 permits users to position the light source 24 over a wide range of positions relative to the support 12. Multiple lamp assemblies supported by multiple necks 14 are also fully contemplated within the scope of the present invention. It should be pointed out that flexible neck 14 must have a resiliency which is sufficient to support a load imposed by the terminal housing 18, the light bulb socket 20 and the lamp shade 22. In particular, the flexible neck 14 may further demonstrate its resiliency by having the characteristic capability of recovering its shape after deformation. With this resiliency, a user can freely position a light source 24 relative to the support 12. More particularly, a load defined by the terminal housing 18, the light bulb socket 20, and the lamp shade 22 must be insufficient to cause the flexible neck 14 to sag or otherwise change its position from that selected by the user. It should be noted that the flexible neck 14 is of a length that is sufficient to not interfere with an electronic device 100 positioned in slots 60 and/or 61.

A power outlet 15 can also be electrically coupled to the power cord 26 in parallel to the bulb socket 20. Power outlet 15 is disposed on an exterior surface of support 12, thereby allowing other devices requiring AC power to be plugged into and powered via the power outlet 15. Any number of power outlets 15 can be disposed on any surface of the support 12 and/or the organizer 15 including the sides, front, back, top or underside of the support 12.

A transformer 40 can also be provided within the support 12. The transformer 40 is electrically coupled to the power cord 26 and is connected in parallel to the bulb socket 20. The on-off switch 30 can also be electrically coupled to the transformer 40, but in another embodiment receives electricity through cord 26 regardless of the position of the switch 30. A circuit board 64 is also provided inside the support 12. A charging circuit of the circuit board 64 is electrically interconnected to socket 50, and to the transformer 40 in order to obtain, for example, a DC voltage generated by the charging circuit. As such, rated voltage can be supplied to the transformer 40, lowered by the transformer 40, and then sent to the charging circuit of circuit board 44 for DC conversion which is supplied to socket 50.

The socket 50 is disposed on an exterior surface of support 12 and is adapted to interface with the charging cable associated with electronic device 100. For example, an iPhone® smart phone sold by Apple Inc. typically employs a cable with a custom pinout on one end which connects to the iPhone® device and a USB connection on the other end which mates with the USB port on a computer or wall charger. The cable allows charging of the iPhone's internal battery through the USB port on a computer or wall charger. Socket 50 on support 12 allows lighting apparatus 10 to be adapted for use with standard electronic device charging cables. Thus, in the example above, when socket 50 is configured to match a USB port, the cable with custom pinout for iPhone can be connected at one end to the iPhone and the other USB port is connected to socket 50. Charging of electronic device 100 can thus be provided through the media device's standard cable connection. Any number of sockets 50 can be disposed on any surface of the support 12 and/or the organizer 15 including the sides, front, back, top or underside of the support 12.

As depicted in FIG. 4, alternatively the DC voltage generated by circuit board 64 can be fed to one or more plugs 46 which are integrated into the support 12 and bottom 54 of organizer 15 at slots 60 or 61 to charge a rechargeable battery within electronic device 100 (not shown). Slots 60 and 61 can be shaped to snugly receive a lower portion of electronic device 100 so as to align or matingly couple the electronic device 100 with electrical plug 46 and thereby act as a socket for electronic device 100. Contact between electrical plug of support 12 and electronic device 100 for example may permit a rechargeable battery housed wholly within electronic device 100 to charge. Alternatively, the plugs 46 can be removably attached to the support 12 and bottom 54 of organizer 15 and electrically coupled to the circuit board 64 by an extendable cable so that the plugs 46 can be retractably extended from the support 12 for attaching one or more electronic devices 100.

Referring to FIG. 6, there is shown a schematic drawing of the lamp and charging circuit of the desk lamp. The transformer 40 is electrically coupled to a commercial AC power source (via cord 26 of FIGS. 2, 3, 4), and to charging circuit of the circuit board 64, so that rated AC voltage produced by the commercial AC power source can be lowered by the transformer 40. The transformer 40 may also be electrically coupled to the terminal 18 to provide a second lowered voltage for operating the lamp (for example, to provide a dimming function via a variable tap or other conventional means). The charging circuit comprises a conventional rectifier 41 electrically coupled to AC output of the transformer 40 for converting AC into DC, and a conventional stabilizer 42 electrically coupled to output of the rectifier 41 for smoothing DC voltage. The stable charging voltage is then fed to socket 50 for charging a battery of media device 100. Alternatively the stable charging voltage can be fed to one or more plugs 46 (not depicted) as depicted in FIG. 4.

Thus, while there have been shown, described, and pointed out fundamental novel features of the invention as applied to several embodiments, it will be understood that various omissions, substitutions, and changes in the form and details of the devices illustrated, and in their operation, may be made by those skilled in the art without departing from the spirit and scope of the invention. Substitutions of elements from one described embodiment to another are also fully intended and contemplated. It is also to be understood that the drawings are not necessarily drawn to scale, but that they are merely conceptual in nature. The invention is defined solely with regard to the claims appended hereto, and equivalents of the recitations therein.

What is claimed is:

1. A lighting apparatus comprising:

a support, the support having a surface for receiving a removable organizer; wherein the organizer has at least two cavities defined by a bottom and one or more peripheral walls and one or more respective interior dividing walls, wherein the one or more respective interior dividing walls of adjacent cavities define one or more slots between the adjacent cavities, and wherein the one or more slots extend to open ends in a direction parallel to the surface so as to receive an electronic device of any width within the one or more slots;

a neck having a first portion coupled to the support and a second portion remote from the first portion;

a terminal housing affixed to the second portion of the neck;

a bulb socket including a seat portion attached to the terminal housing, and a shell portion shaped to receive a base of a light bulb; and a power cord coupled to the bulb socket and to an electrical plug.

2. The lighting apparatus of claim 1 wherein the support further includes one or more power outlets disposed on the support, the one or more power outlets having a first end that is directed internally of the support and is electrically coupled to the power cord, and having a second end that is accessible at an external surface of the support.

3. The lighting apparatus of claim 1 wherein the support houses a transformer electrically coupled to the power cord and a charging circuit electrically connected to the transformer.

4. The lighting apparatus of claim 3 further comprising a socket disposed on the support, the socket having a first end that is directed internally of the support and is electrically coupled to the charging circuit, and having a second end that is accessible at an external surface of the support for electrical coupling to an electronic device compatible cable.

5. The lighting apparatus of claim 3 further comprising at least one plug disposed on the support and the organizer, the plug having a first end that is directed internally of the support and is electrically coupled to the charging circuit, and having a second end that is accessible at an external surface of the organizer for electrical coupling to an electronic device.

6. The lighting apparatus of claim 1 wherein the one or more slots are defined by the respective interior dividing walls to have a curvature such that the one or more slots are shaped to receive the electronic device in a particular location and orientation of the one or more slots.

7. The lighting apparatus of claim 1 wherein the one or more slots are covered with a material that protects an electronic device from damage when placed in the one or more slots.

8. The lighting apparatus of claim 1, further comprising: a switch that is electrically coupled to the power cord for switchably directing power to the bulb socket; wherein the switch is operable by one of a push, a pull, a toggle, and a rotary action.

9. The lighting apparatus of claim 1, wherein the support and organizer are shaped to define one or more orifices in the support and organizer.

10. The lighting apparatus of claim 1, wherein the support comprises a sheet metal stamping.

11. The lighting apparatus of claim 1, wherein the support comprises an injection-molded plastic.

12. The lighting apparatus of claim 1, wherein the organizer comprises a sheet metal stamping.

13. The lighting apparatus of claim 1, wherein the organizer comprises an injection-molded plastic.

14. The lighting apparatus of claim 1, wherein the removable organizer is removably attached to the support.

15. A lighting apparatus comprising:

a support, the support having a surface for receiving an organizer, wherein the organizer is configured to join the support and wherein the organizer has at least two cavities each defined by a respective bottom and one or more respective peripheral walls and one or more respective interior dividing walls, wherein the one or more respective interior dividing walls of adjacent cavities define one or more slots between the adjacent cavities, and wherein the one or more slots each extend to open ends in the peripheral walls to the surface so as to receive an electronic device of any width within the one or more slots;

a neck having a first portion coupled to the support and a second portion remote from the first portion;

a terminal housing affixed to the second portion of the neck;

a bulb socket including a seat portion attached to the terminal housing and a shell portion shaped to receive a base of a light bulb; and a power cord coupled to the bulb socket and to an electrical plug.

16. The lighting apparatus of claim 15, wherein the organizer is configured to join the support using one or more locating features.

17. The lighting apparatus of claim 15, wherein the support is shaped to define a locating feature, and wherein a bottom of the organizer is formed to define a complementary locating feature, and wherein the organizer is joined to the support using the locating feature and complementary locating feature.

18. The lighting apparatus of claim 15, wherein the organizer is removably joined to the surface of the support.

* * * * *